United States Patent [19]

Adler et al.

[11] 3,982,218

[45] Sept. 21, 1976

[54] TEMPERATURE SENSING DEVICE AND METHOD

[75] Inventors: Meryle D. W. Adler; John T. Brown, both of Bradford, Pa.

[73] Assignee: Corning Glass Works, Corning, N.Y.

[22] Filed: Sept. 19, 1974

[21] Appl. No.: 507,284

[52] U.S. Cl. ..... 338/22 R; 204/38 B; 338/308; 338/309; 427/102; 427/103; 427/124; 427/125; 427/126; 427/343; 427/352; 427/383; 338/300

[51] Int. Cl.[2] ..... B05D 5/12; H01C 7/04

[58] Field of Search ..... 427/102, 103, 123, 124, 427/125, 126, 343, 331, 299, 383, 352; 29/612, 620, 621; 338/308, 309, 22 R, 300; 204/38 B

[56] References Cited

UNITED STATES PATENTS

| | | | |
|---|---|---|---|
| 2,671,950 | 3/1954 | Sukacev | 29/620 |
| 2,803,729 | 8/1957 | Kohring | 338/257 |
| 2,915,730 | 12/1959 | Davis | 338/309 |
| 3,217,281 | 11/1965 | Griest et al. | 338/309 |

*Primary Examiner*—Cameron K. Weiffenbach
*Attorney, Agent, or Firm*—Walter S. Zebrowski; Clarence R. Patty, Jr.

[57] ABSTRACT

A temperature sensing device and a method of forming it is disclosed. A first film or coating of an adherent electro-conductive metallic oxide is applied over the exterior surface of a dielectric substrate. The metal oxide coating is thereafter thoroughly cleansed and a second coating or layer of a metal having a relatively high temperature coefficient of resistance is applied over the metallic oxide film so as to form a strong physical bond as well as a chemical bond therebetween. The composite so formed is fired at a temperature up to about 750°C. If desired, the metal layer is thereafter suitably spiralled to provide the desired resistance and terminal leads are attached to the element. Also, if desired, the element is then coated with a dielectric protective coating.

19 Claims, 6 Drawing Figures

TEMPERATURE SENSING DEVICE AND METHOD

BACKGROUND OF THE INVENTION

1. Field of the Invention

The present invention relates to resistance temperature sensing devices, but in particular to metal film, positive temperature coefficient of resistance (TCR) temperature sensing devices.

2. Description of the Prior Art

Various resistance temperature sensing devices such as thermisters, PN junction transistors, wire wound resistors, and the like have been known in the prior art, but each of such prior art devices has numerous disadvantages thereby rendering it generally unsuitable for wide scale application. For example, thermisters have poor thermal stability as well as poor repeatability. In general thermisters are relatively expensive and have a negative temperature coefficient of resistance. Similarly, PN junction transistors have poor repeatability and a negative temperature coefficient of resistance. Wire wound resistors, on the other hand, have an undesirably high change in resistance due to mechanical vibration and poor thermal stability. Such wire wound resistors also are relatively expensive. In addition to such disadvantages, thermisters do not have a linear response nor a relatively linear response. Furthermore, the construction of certain of the prior art temperature sensing devices requires costly equipment and complicated assembly work.

SUMMARY OF THE INVENTION

The objects of this invention are to provide a resistance temperature sensing device, assembly, and method of manufacture which is economical, provides a positive temperature coefficient of resistance, has low change of resistance due to vibration, high thermal stability and repeatability, a substantially linear response, permits economic attachment of terminal leads, and overcomes the heretofore noted disadvantages.

Broadly, according to the present invention, a resistance temperature sensing device is formed by first applying an adherent electroconductive film or coating of metallic oxide to the exterior surface of a dielectric substrate. The metal oxide coating is thereafter thoroughly cleansed and a second coating or layer of metal having a relatively high temperature coefficient of resistance is applied over the metallic oxide film so as to form a strong physical bond as well as a chemical bond therebetween. The composite so formed is fired in a furnace. To obtain the desired resistance of the device, the metal layer and oxide coating may thereafter be suitably spiralled. A pair of terminal leads are affixed to the device in electrical contact with said metal layer and the unit is coated with a dielectric protective coating, if desired.

Additional objects, features, and advantages of the present invention will become apparent to those skilled in the art, from the following detailed description and the attached drawing on which, by way of example, only the preferred embodiments of this invention are illustrated.

DETAILED DESCRIPTION

It is to be noted that the drawings are illustrative and symbolic of the invention, and there is no intention to indicate scale or relative proportion of the elements shown therein.

Figure 1:
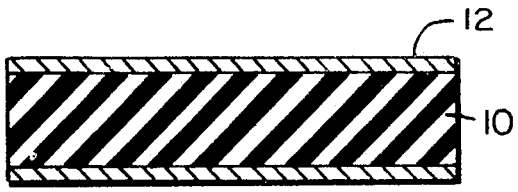
FIG. 1 is a cross-sectional view of a dielectric substrate having a first coating or film of metallic oxide applied thereto.

Referring to FIG. 1, there is shown a dielectric substrate 10 to which a first coating 12 of an adherent electroconductive film of metallic oxide is applied to the exterior surface. The dielectric substrate may be glass, ceramics, glass-ceramics, or organic materials such as compatible plastics. The substrate may be in the form of a cylinder, tube, or flat sheets. The electroconductive metal oxide film is preferably a tin-antimony oxide having an antimony content ranging from 0.5 to 6.5 percent by weight. The tin-antimony oxide film may also have other additives such as indium oxide, iron oxide, nickel oxide, cadmium oxide or zinc oxide if desired. Other oxides that would adhere well and be compatible with the substrate and metal layer, and have a resistivity of less than about 100 ohm per square would also be suitable for the present invention. A particularly suitable metallic oxide coating may be formed of two films, the substrate film and the conducting film, as described in U.S. Pat. No. 3,217,281 issued to E. M. Griest et al. Other suitable metal oxide films and methods for producing such films are described in U.S. Pat. Nos. 2,564,706 and 2,564,707 issued to John M. Mochel and U.S. Pat. Nos. 2,915,730 and 2,934,736 issued to James K. Davis. Each of the five preceding patents to Griest et al., Mochel, and Davis are herein expressly incorporated be reference. Resistivity from about 1 to about 100 ohms per square for the first electroconductive coating is satisfactory for the purposes of the present invention.

Figure 2:
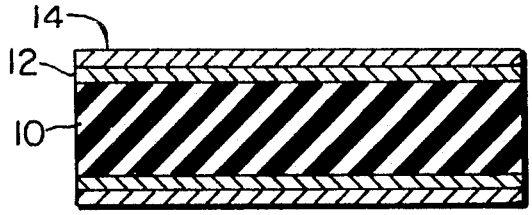
FIG. 2 is a cross-sectional view of the device of FIG. 1 having a second layer or coating of metal applied over said first coating.

Referring to FIG. 2, there is shown a metallic coating or layer 14 applied to the surface of first coating 12. Metallic coating or layer 14 is preferably nickel but may also be chromium, zirconium, zinc, molybdenum, iron, platinum, and other noble metals. The metallic coating or layer may be deposited on first coating 12 by vacuum deposition, sputtering, chemical vapor deposition, electroplating, or the like. In order to form a strong physical as well as chemical bond between the metallic coating or layer 14 and first metallic oxide coating 12 the surface of the metallic oxide is thoroughly cleansed to remove all water soluble and non-water soluble films, oils, and other contaminants. A suitable cleansing method involves a first base wash followed by a water rinse and thereafter an acid wash. The article would again be rinsed in water following the acid wash. A suitable acid bath may be a 13 percent solution of Udylite Oxyvate 345 general purpose dry acid salt manufactured by the Udylite Company, Detroit, Michigan. This acid solution is sodium acid sulfate dissolved in water with a suitable wetting agent. Other suitable materials for an acid bath are potassium hydrogen sulfate and sodium hydrogen sulfate. One suitable base bath is a 5 percent solution of Udylite Oxyprep 101 phosphate-free alkyline soak cleaner. This base bath is an aqueous solution of sodium hydroxide. Other suitable materials for a base bath are potassium hydroxide and sodium carbonate. To suitably cleanse the exterior surface of the metallic oxide coating, a quantity of substrates with the metal oxide coating are first immersed in a base bath for about 10 minutes and then thoroughly rinsed in water. Thereafter, these substrates are immersed in the acid bath for about 10 minutes also followed by a thorough water rinse. Preferably, the substrates are caused to be agitated in each of the acid and base baths.

After the metallic coating or layer 14 is applied to the exterior surface of the first metallic oxide coating 12, the substrates are again thoroughly washed in tap water and air dried. Thereafter, the elements are heat treated by passing them through a furnace. Such heat treatment varies in temperature and time depending on the particular metallic coating or layer applied. For example, if the metallic coating or layer is nickel then heat treating may take place at a maximum temperature of 450°C for about 5 minutes, whereas if the metallic coating or layer is platinum heat treating may take place at a temperature of up to 750°C for about 20 minutes. Such heat treating conditions the metallic coating or layer and enhances the bond and structural characteristics of the coating or layer. Such heat treatment also affects the density and grain size of the metal as well as the grain boundary impurities which have a strong influence on electrical properties such as temperature coefficient of resistance, resistivity, and long-term stability.

Figure 3:
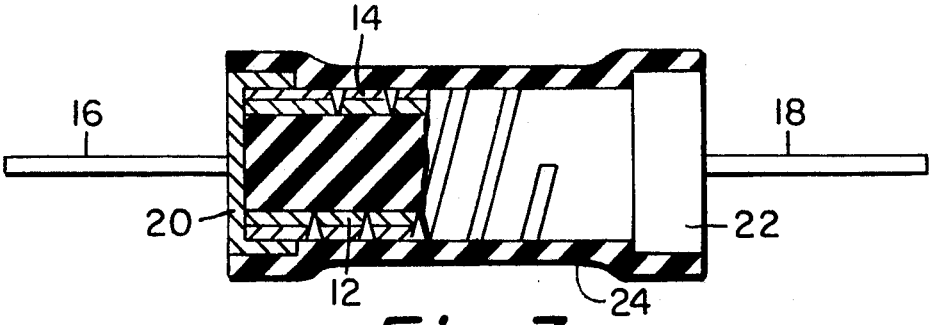
FIG. 3 is an elevational view, partly in section, of the resistance temperature sensing device of the present invention.

After the metallic coating or layer 14 is applied, thoroughly rinsed and fired, the metal layer and oxide coating on the element may be spiralled so as to obtain a desired resistance value. Such spiralling may be performed by any suitable means such as a mechanical wheel, laser spiralling, or the like, as known in the art. Thereafter, a pair of terminal leads 16 and 18 may be attached to the ends of the device by means of a pair of caps 20 and 22 respectively, as illustrated in FIG. 3. This substantially completes the resistive temperature sensing device except for the addition of a dielectric protective coating 24. Suitable materials for a dielectric protective coating 24 may be silicones, alkyds, polyesters, epoxies, urethanes, fluoropolymers, polyimides, and the like.

Figure 4:
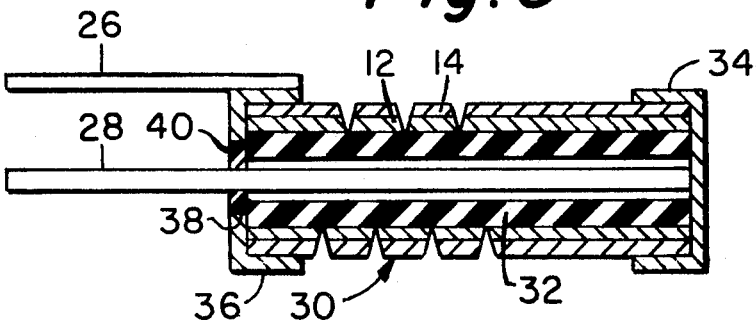
FIG. 4 is a cross-sectional view of another embodiment of a resistance temperature sensing device of the present invention.

Referring now to FIG. 4, there is illustrated another embodiment of the present invention wherein both terminal leads 26 and 28 are provided at one end of resistance temperature sensing device 30. In this embodiment, device 30 is formed as described in connection with FIGS. 1 through 3 except that dielectric substrate 32 is tubular in form rather than a solid cylinder. After the first electroconductive coating 12 and the metallic coating or layer 14 is applied, terminal end cap 34 is fixedly attached to one end of device 30 in electrical contact with metallic coating or layer 14. A second terminal cap 36 having a central aperture 38 formed therein is attached to the other end of device 30 in electrical contact with metallic coating 14. Terminal lead 26 is attached to terminal cap 36 while terminal lead 28 is attached to terminal cap 34. As is seen from the drawing, lead 28 is extended through the central aperture of tubular substrate 32 and extends in the same direction as terminal lead 26. To prevent electrical contact between terminal lead 28 and terminal cap 36, a dielectric spacer or grommet 40 may be disposed within aperture 38.

Figure 5:
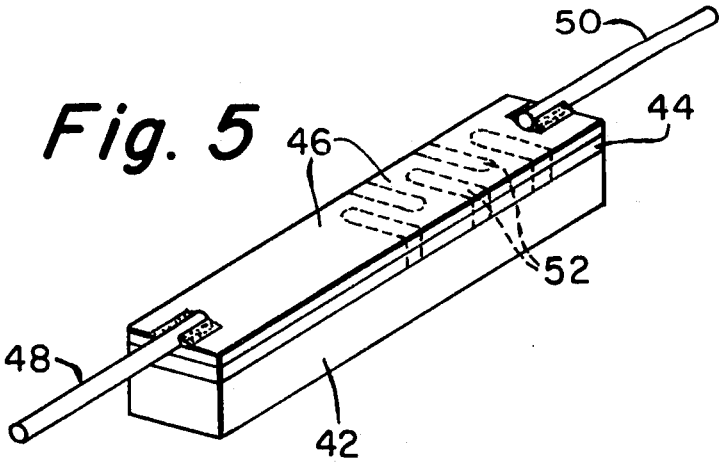
FIG. 5 is an oblique view of a still further embodiment of a resistance temperature sensing device of the present invention.

Referring to FIG. 5, there is seen still another embodiment of the present invention wherein substrate 42 is in sheet or flat form and the first electroconductive coating 44 is applied to one surface thereof. Metallic coating or layer 46 is similarly applied over the first electroconductive coating 44 as heretofore described. Leads 48 and 50 are then attached to metallic coating or layer 46 in electrical contact therewith at opposite ends of the device. As will be understood, if the length of the path between terminals 48 and 50 is desired to be increased, metallic layer 46 and oxide coating 44 may be tailored by removing selected portions thereof as illustrated by dotted lines 52.

As a typical example, a resistive temperature sensing device is formed by first providing a dielectric substrate of alkali-free glass as described in the heretofore noted Griest et al. patent. The first electroconductive coating was applied to the exterior surface of the alkali-free glass substrate in accordance with the teaching of applying the substrate and conducting films in said Griest et al. patent. The film deposition is in accordance with techniques well known in the art and fully set forth in the previously noted Mochel and Davis patents which describe procedures for depositing substantially homogeneous films of metal oxides by irridizing. The substrate film was composed of about 30 percent antimony oxide and 70 percent tin oxide, while the conducting film was composed of about 3.5 percent antimony oxide and 96.5 percent tin oxide. The resulting first electroconductive coating had a resistivity of about 15 ohms per square.

The article so formed is then cleansed by immersing it in a base bath composed of about 5 percent solution of Udylite Oxyprep 101 phosphate-free alkaline soak for about 10 minutes followed by thorough water rinse. The article is then immersed in an acid bath of about 13 percent solution of Udylite Oxyvate 345 for about 10 minutes and again followed by a thorough water rinse.

The article or element so formed is then electrolytically plated as follows. A plurality of elements or articles are disposed in a porous non-reactive material container. This container is then filled with a quantity of stainless steel balls to distribute the current substantially equally through the electroconductive coatings on the plurality of elements. The container is electrically wired so that all of the elements contained therein form the cathode of an electro-chemical cell. The container with the device elements and the stainless steel balls is immersed in a temperature controlled plating bath maintained at a temperature of about 107°F. This bath may consist of an aqueous solution of 24–30 oz. per gal. of nickel sulfamate, 0.5–1 oz. per gal. of nickel chloride, 3–5 oz. per gal. of boric acid, and 0.1–0.2 percent by volume of a wetting agent, such for example as Udylite No. 62-A. Upon total immersion of the container a DC current of about 14 amperes is applied for about 6 minutes through the solution and device elements followed by 10 amperes for 6 additional minutes, and finally followed by 6 amperes for a third 6 minutes. The voltage in each case is about 10 volts. Such plated elements have a resistivity of about 0.1 ohms per square.

After the elements have been nickel plated in such manner, they are then rinsed in water and air dried. Thereafter, the elements are fired by passing through a belt-driven kiln at a maximum temperature of 450°C for about 5 minutes.

The first tin-antimony oxide film and the nickel film are then spiralled to increase the length of the electrical path therethrough and to increase the resistance thereof. Such spiralling is accomplished by vaporizing both films as a result of focusing a laser beam onto the coatings while the element is being rotated in a manner well known in the art. The device is then terminated by affixing to each end thereof a cap and terminal lead in electrical contact with each end of the nickel coating. A protective coating of polyimide resin is applied to the exterior surfaces for environmental protection.

Figure 6:
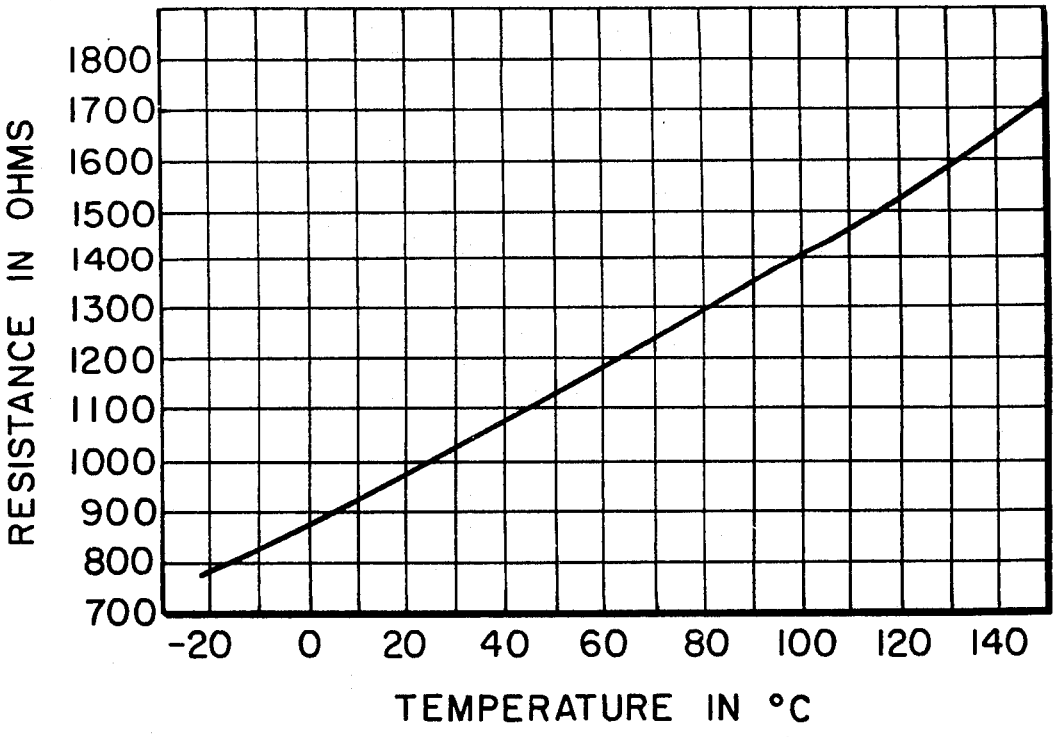
FIG. 6 is a graph illustrating the resistance vs. temperature relationship of a typical device of the present invention.

It has been found that a device formed in accordance with the above typical example has a resistance to temperature relationship as shown in FIG. 6 of the drawing Further, such a device has very a low change of resistance due to vibration, and very good thermal stability as well as excellent repeatability. Further, the device costs are low, the device provides substantially linear response and has a positive temperature coefficient of resistance.

Although the present invention has been described with respect to details of certain embodiments thereof it is not intended that such details be limitations upon the scope of the invention except insofar as set forth in the following claims.

We claim:

1. A device for sensing temperature comprising
a dielectric substrate,
a first adherent electroconductive film of a metallic oxide on the exterior surface of said substrate,
a layer of metal disposed over substantially the entire surface of said metallic oxide film selected from the group consisting of nickel, chromium, platinum, zirconium, zinc, molybdenum, and iron, and
a pair of terminals affixed to the ends of said substrate in electrical contact with said layer of metal.

2. The device of claim 1 wherein said layer of metal is nickel.

3. The device of claim 1 further comprising a dielectric protective coating applied to the exterior surface of said device, said terminal leads extending beyond said protective coating.

4. The device of claim 1 wherein said layer of metal is spiralled to increase the resistivity thereof.

5. The device of claim 1 wherein said dielectric substrate is an alkali-free glass.

6. The device of claim 1 wherein said first adherent electroconductive film of metallic oxide is a tin-antimony oxide.

7. The device of claim 6 wherein said tin-antimony oxide film has a resistivity of up to about 100 ohms per square, the layer of metal is nickel, and the dielectric substrate is an alkali-free glass.

8. A method of forming a temperature sensing device comprising
providing a dielectric substrate,
forming an adherent coating of an electroconductive metallic oxide on the surface of said substrate,
applying a layer of metal over substantially the entire surface of said metallic oxide selected from the group consisting of nickel, chromium, platinum, zirconium, zinc, molybdenum, and iron, and then
heating the composite so formed to a temperature up to 750°C.

9. The method of claim 8 wherein said metallic oxide coating is a coating of tin-antimony oxide having a resistivity of up to about 100 ohms per square.

10. The method of claim 8 wherein said layer of metal is applied by electroplating.

11. The method of claim 8 wherein said layer of metal is applied vapor deposition.

12. The method of claim 8 further comprising the step of increasing the electrical path of the coating of metallic oxide and layer of metal by spiralling.

13. The method of claim 8 wherein said layer of metal is nickel.

14. The method of claim 8 wherein said dielectric substrate is alkali-free glass.

15. The method of claim 8 further comprising the step of affixing terminal leads to said device.

16. The method of claim 15 further comprising the step of applying a dielectric protective coating over the exterior surface of said device so formed, said terminal leads extending therebeyond.

17. The method of claim 8 further comprising the following steps before applying said layer of metal
immersing the substrate-metallic oxide coating the composite in a base bath,
rinsing said composite,
immersing said composite in an acid bath, and thereafter rinsing said composite.

18. The method of claim 17 further comprising the step of affixing terminal leads to said device.

19. The method of claim 18 wherein said metallic oxide coating is a coating of tin-antimony having a resistivity of up to about 100 ohms per square, the layer of metal is nickel, and the dielectric substrate is alkali-free glass.

* * * * *